US005955796A

United States Patent [19]

Nilssen

[11] Patent Number: 5,955,796

[45] **Date of Patent: *Sep. 21, 1999**

[54] PROGRAMMABLE WALL SWITCH ACTUATOR/TIMER

[76] Inventor: Ole K. Nilssen, Caesar Dr., Rte. #5, Barrington, Ill. 60010

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 08/287,409

[22] Filed: Aug. 8, 1994

Related U.S. Application Data

[63] Continuation of application No. 06/717,441, Mar. 28, 1985, abandoned.

[51] Int. Cl.[6] ..... H01H 7/08

[52] U.S. Cl. ..... 307/140; 307/126; 307/141; 307/141.4; 307/141.8; 315/360; 200/38 R; 200/38 B

[58] Field of Search ..... 307/141, 141.04, 307/132 E, 140, 150, 119, 126, 134; 368/246, 256, 258, 259, 10; 315/360; 200/17 R, 33 R, 33 B, 34, 330, 38 A, 38 B

[56] References Cited

U.S. PATENT DOCUMENTS

| | | | |
|---|---|---|---|
| 2,905,776 | 9/1959 | Eisenberg et al. | 200/39 R |
| 3,249,931 | 5/1966 | Leitton et al. | 200/35 R |
| 3,571,711 | 3/1971 | Nemetz | 325/166 |
| 3,696,381 | 10/1972 | Wallace | 340/309.15 X |
| 3,740,680 | 6/1973 | Schneidinger | 200/33 B X |
| 3,818,156 | 6/1974 | Augustyniak | 200/33 R |
| 3,889,132 | 6/1975 | Vreeland | 307/141 |
| 3,985,133 | 10/1976 | Jenkins et al. | 128/214 E |
| 3,985,982 | 10/1976 | Schneidinger | 200/33 R |
| 4,002,925 | 1/1977 | Monahan | 307/141 |
| 4,041,325 | 8/1977 | Angott | 307/141 |
| 4,164,635 | 8/1979 | Finch et al. | 200/33 R |
| 4,194,182 | 3/1980 | Martin | 340/309.15 X |
| 4,259,618 | 3/1981 | Nilssen | 307/140 |
| 4,297,546 | 10/1981 | Koch | 200/38 R |
| 4,508,943 | 4/1985 | Pfeiffer et al. | 200/33 R X |
| 4,524,252 | 6/1985 | Okazaki et al. | 200/38 E |
| 4,570,216 | 2/1986 | Chan | 307/141 X |
| 4,645,942 | 2/1987 | Nilssen | 307/141 |
| 4,712,019 | 12/1987 | Nilssen | 307/141 |
| 4,835,413 | 5/1989 | Nilssen | 307/141 |
| 4,942,348 | 7/1990 | Nilssen | 318/468 |
| 5,309,032 | 5/1994 | Nilssen | 307/140 |

*Primary Examiner*—Paul Ip

[57] ABSTRACT

A self-contained programmable wall switch actuator/timer unit can easily be mounted directly onto the outside of the face plate of a standard wall switch. This actuator/timer unit can be programmed to operate the lever of the wall switch in accordance with a program that automatically repeats on a diurnal, weekly or other cyclical basis. It comprises a small battery, a miniature electric motor with a gear/linkage mechanism operable to engage with and to move the switch lever between its OFF and ON positions, and a quartz-clock-based programming means having programming intput keys and time display means. Once programmed by way of the programming input keys, the programming means is operative to actuate the electric motor in such manner as to move the switch lever into its ON and/or OFF position in accordance with the keyed-in program. In its anticipated most common operating mode, which includes two ON-actuations and two OFF-actuations per day, in addition to occasional override-actuations, the small battery will last for years before needing replacement.

5 Claims, 2 Drawing Sheets

PROGRAMMABLE WALL SWITCH ACTUATOR/TIMER

This application is a continuation of Ser. No. 06/717,441 filed Mar. 28, 1985, now abandoned.

BACKGROUND OF THE INVENTION

1. Field of Invention

The present invention relates to a means operable to actuate a load by way of a wall switch and in accordance with a program of repeated ON/OFF actuations, particularly a means that operates independently of the power line and that can be mounted right onto the face plate of a standard wall switch.

2. Prior Art

A variety of means for actuating a load from a wall switch have been described in prior art, where they are often referred to as wall switch timers. Examples of such wall switch actuators/timers are described in various U.S. patents, such as in: U.S. Pat. No. 3,179,758 to Trock; U.S. Pat. No. 3,491,249 to Rabinow; U.S. Pat. No. 3,740,680 to Schneidinger; U.S. Pat. No. 3,889,132 to Vreeland; U.S. Pat. No. 3,979,601 to Franklin; U.S. Pat. No. 3,985,982 to Schneidinger; U.S. Pat. No. 4,021,626 to Becker; U.S. Pat. No. 4,259,618 to Nilssen; U.S. Pat. No. 4,274,045 to Goldstein; U.S. Pat. No. 4,344,000 and U.S. Pat. No. 4,354,120, both to Schornack; U.S. Pat. No. 4,360,739 to Goldstein; and RE 31,848 to Nilssen.

There are two distinctly different types of such actuators/timers. A first type that is mountable on the outside of an already installed ordinary wall switch, as for instance described in U.S. Pat. No. 3,740,680 to Schneidinger, provides for means to turn a light ON (or OFF) for a predetermined time interval (and, optionally, after a predetermined time-delay), but does not provide for repetitive ON/OFF actuations. A second type, as for instance described in U.S. Pat. No. 4,259,618 to Nilssen, does provide for repetitive ON/OFF actuations, but must be wired-in and used in lieu of an ordinary wall switch.

SUMMARY OF THE INVENTION

Objects of the Invention

One object of the present invention is that of providing for a compact self-contained wall switch actuator/timer means capable of repeatedly actuating the switch lever of a standard wall switch in accordance with a presettable time-program.

Another object is that of providing for an attractive-looking programmable wall switch actuator/timer means that is particularly easy to install by persons of but ordinary skills.

These as well as other important objects and advantages of the present invention will become apparent from the following description.

BRIEF DESCRIPTION

In its preferred embodiment, subject invention constitutes a self-contained programmable wall switch actuator/timer unit that can easily be mounted directly onto the outside of the face plate of a standard wall switch. This actuator/timer unit can be programmed to operate the lever of the wall switch in accordance with a program that automatically repeats on a diurnal, weekly or other more-or-less cyclical basis. It comprises a small center-tapped battery, a miniature electric motor with a gear/linkage mechanism operable to engage with and to move the switch lever into its ON and/or OFF position, and a quartz-clock-based time-programming means having programming intput keys and time display means. Once programmed by way of the programming input keys, the programming means is operative to actuate the electric motor in such manner as to move the switch lever into its ON and/or OFF position in accordance with the keyed-in program. In its anticipated most common operating mode, which includes two ON-actuations and two OFF-actuations per day, in addition to occasional override-actuations, the small battery will last for years before needing replacement.

BRIEF DESCRIPTION OF THE DRAWINGS

FIG. 2 shows subject actuator/timer unit in two perspective views.

DESCRIPTION OF THE PREFERRED EMBODIMENT

Details of Construction

Figure 1:
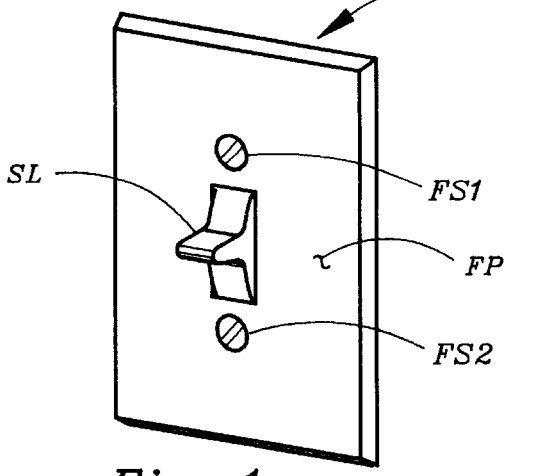
FIG. 1 represents an external view of a standard wall switch.

FIG. 1 shows a predominantly frontal view of a standard wall switch SWS. This wall switch has a face plate FP, a switch lever SL and two fastening screws FS1 and FS2.

Figure 2A:
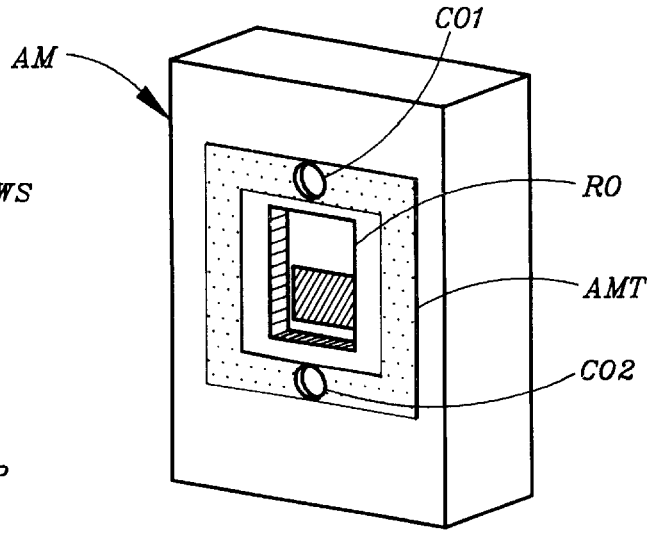
FIG. 2*a* shows a view predominantly from the rear.

FIG. 2*a* shows a view predominantly from the rear of subject actuator/timer unit ATU. Positioned substantially in the middle of the rear surface of this actuator/timer unit is a rear opening RO operable to receive switch lever SL.

Adhesive mounting tape AMT is positioned on the back surface of actuator/switcher unit ATU in a substantially rectangular fashion centered around the rear opening RO. Two cut-outs CO1 and CO2 have been provided in the tape so as to allow room for the heads of fastening screws FS1 and FS2 after ATU is mounted onto the faceplate FP of the standard wall switch SWS.

Figure 2B:
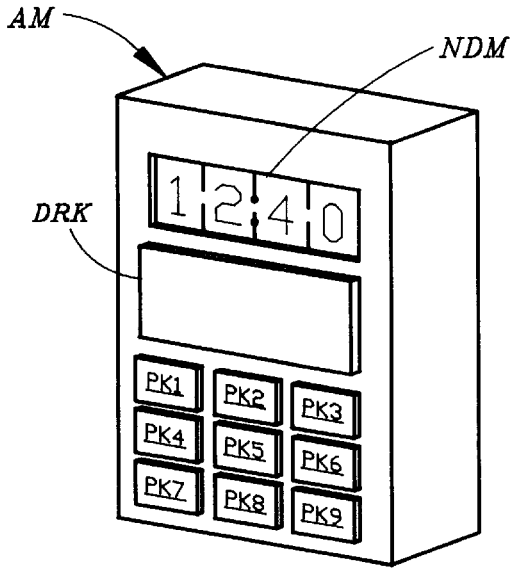
FIG. 2*b* shows a view predominantly from the front.

FIG. 2*b* shows a view predominantly from the front of subject actuator/timer unit ATU. Positioned near the top of the front surface is a numeric display means NDM, below which—positioned approximately in the center of the front surface—is a relatively large size over-ride key ORK. Near the bottom of the front surface is a set of nine calculator-type programming keys PK1 to PK9.

Figure 3:
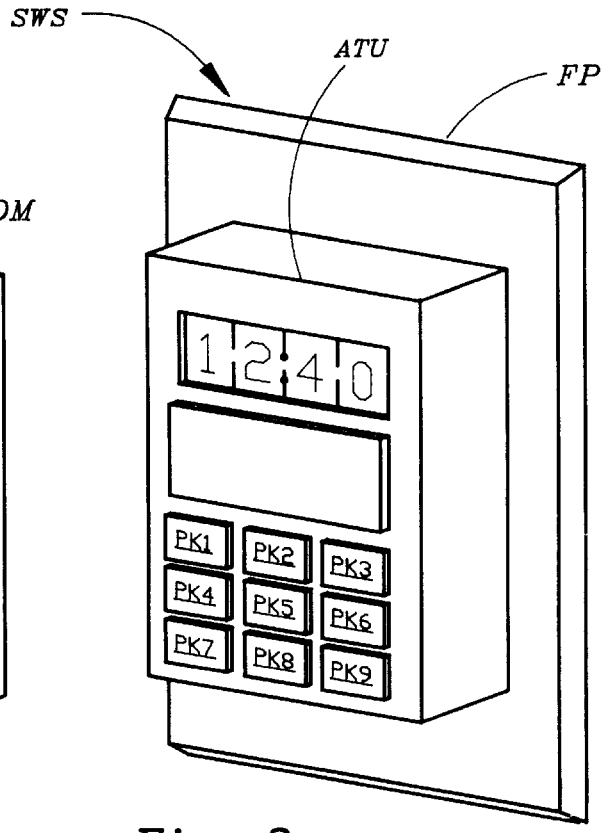
FIG. 3 shows the actuator/timer unit as mounted on a standard wall switch.

FIG. 3 shows the actuator/timer unit ATU mounted on a standard wall switch SWS, being fastened right onto the face plate FP thereof by way of the adhesive mounting tape AMT.

Figure 4:
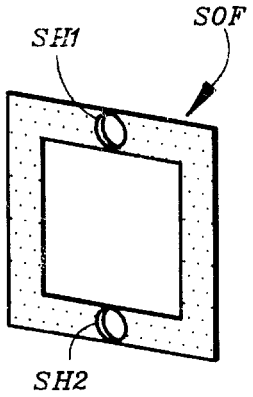
FIG. 4 illustrates a screw-on frame helpful in fastening the actuator/timer to the faceplate of a standard wall switch.

FIG. 4 shows a rectangular screw-on frame SOF having a pair of screw-holes SH1 and SH2 so positioned as to permit this frame to be screwed directly onto the wall-switch face plate by way of the two fastening screws FS1 and FS2. The shape of this screw-on frame is substantially the same as that of adhesive mounting tape AMT.

Figure 5:
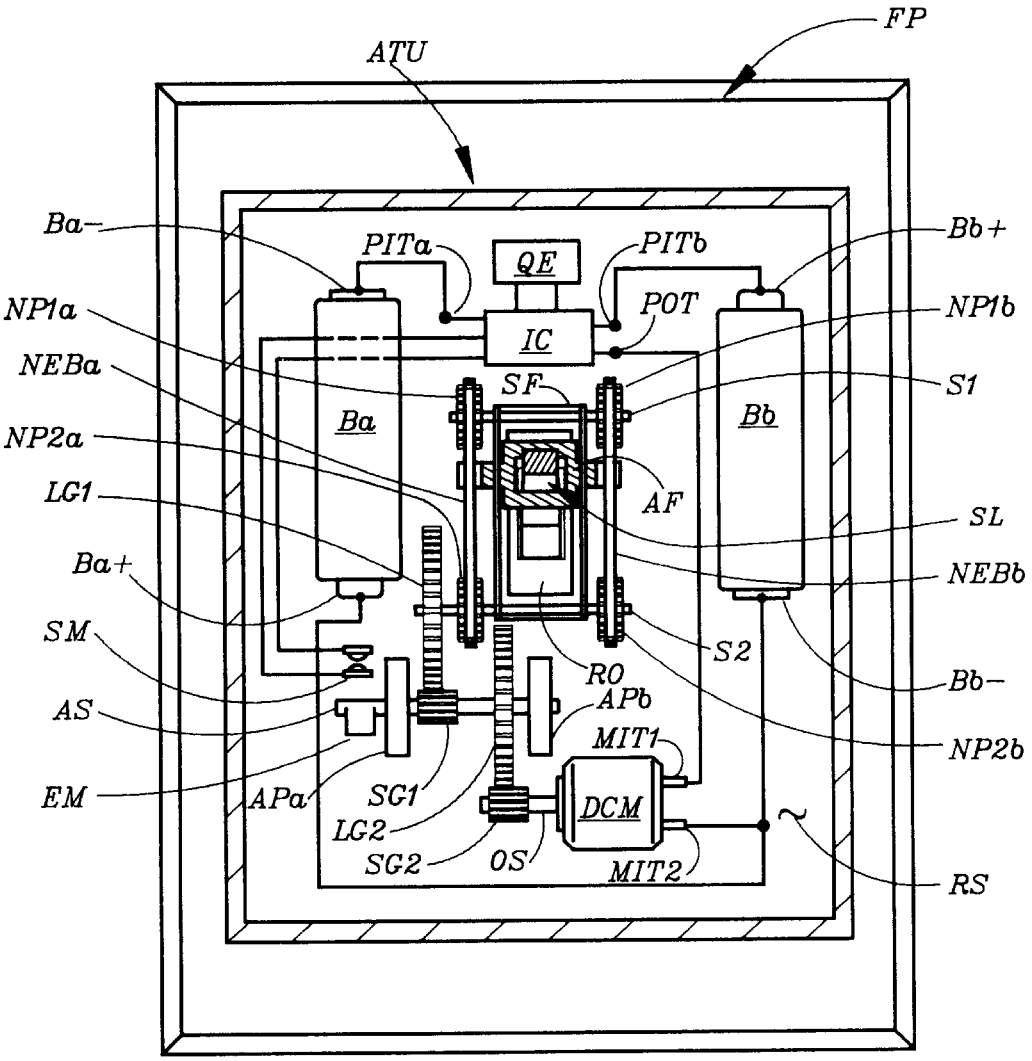
FIG. 5 represents a front view of the key components comprised within the actuator/timer unit.

FIG. 5 shows a schematic frontal view of the inside of actuator/timer unit ATU as mounted onto the face plate FP of a standard wall switch. Switch lever SL, which protrudes through rear opening RO, is shown in its ON position.

Surrounding the rear opening and fastened onto the rear surface RS of the actuator/timer unit is a rectangular support frame SF. A first shaft S1 with notched pulleys NP1*a* and NP1*b* is supported by this frame near its upper extremity; a second shaft S2 with notched pulleys NP2*a* and NP2*b* is supported by this frame near its lower extremity. Both of these shafts are free to rotate, but are not free to move in any other respects.

A small notched endless belt NEBa connects pulley NP1*a* with pulley NP2*a*; and a small notched endless belt NEBb similarly connects pulley NP1*b* with pulley NP2*b*. Symmetrically fastened onto both of these endless belts is an actuator frame AF; which frame is so made and positioned as to embrace switch lever SL. As the actuator frame AF moves, it slides on support frame SF.

Shaft S2 has an extension onto which is mounted a first large gear LG1. An auxiliary shaft AS is rotatably mounted between two auxiliary posts APa and APb; which posts are fastened to the rear surface RS. Mounted onto this auxiliary shaft is a second large gear LG2 and a first small gear SG1. This first small gear SG1 is engaged with the first large gear LG1.

Also mounted onto an extension of this auxiliary shaft AS is an eccentric means EM that operates a prefereably bistable switch means SM once for each complete revolution of shaft AS. This switch means has two terminals, both of which are connected with integrated circuit IC.

A small DC motor DCM is mounted on rear surface RS. On the output shaft OS of this DC motor is mounted a second small gear SG2. This second small gear SG2 is engaged with the second large gear LG2. The DC motor has two electrical power input terminals MIT1 and MIT2.

A first battery Ba is positioned on the left hand side of rear surface RS; and a second battery Bb is positioned on the right hand side of rear surface RS. Battery Ba has a Ba− terminal and a Ba+ terminal, with the Ba− terminal being of negative polarity with respect to the Ba+ terminal. Similarly, battery Bb has a Bb− terminal and a Bb+ terminal, with the Bb− terminal being of negative polarity with respect to the Bb+ terminal. The Ba+ terminal is electrically connected with the DC motor's MIT2 terminal as well as with the Bb− terminal.

Integrated circuit IC and a quartz element QE are located near the upper part of the actuator/timer unit—in a position that would be substantially directly underneath the numeric display means NDM of FIG. 2*b*. This IC has a relatively large number of electrical terminals, most of which are connected with the quartz element QE, the numeric display means NDM, the programming keys PK1 to PK9, and the over-ride key ORK. However, for sake of clarity, and also since they form no part of the present invention, the detailed electrical connections between the IC and QE, NDM, PK1 to PK9, and ORK are not shown.

The remaining IC electrical terminals and connections are shown: electrical power input terminal PITa is electrically connected with battery terminal Ba−; electrical power input terminal PITb is electrically connected with battery terminal Bb+; electrical power output terminal POT is electrically connected with motor input terminal MIT1; and the two terminals of switch means SM is connected with two terminals on the IC.

As indicated in FIG. 3, the size and shape of the overall actuator/timer unit is such as to fit well within the confines of the face plate. To provide for attractive styling, the unit's depth or thickness dimension has been made as shallow as permissible by the size of the switch lever, yet without having the switch lever exposed.

The relatively large over-ride key ORK can be removed, thereby to expose the switch lever for direct manual actuation—over-riding the motor/gear/linkage mechanism if necessary.

To permit such over-ride, the actuator frame AF is fastened to the notched endless belts NEBa and NEBb by way of a detent means, thereby allowing slippage between belts and actuator frame when force exceeds a certain predetermined level.

To permit the size and shape of subject actuator/timer unit to be as compact as desired, which degree of compactness is in effect specified by FIG. 3, it is important that the individual components comprised within the actuator/timer unit be fittingly small. In practical reality, this concern is only important in respect to the battery and the motor.

Thus, the electrical power required to be supplied from the built-in battery must be modest enough to permit this battery to be small enough to reasonably fit within the desired specified dimensions of the actuator/timer unit. Similarly, the mechanical power required to be supplied by the built-in motor must be modest enough to permit this motor to be small enough to reasonably fit within the specified dimensions.

Since a certain amount of energy is required to effect actuation of the switch lever, the power required is inversely proportional to the time allowed to effect this actuation. Thus, by way of a speed-reducing gear mechanism, it becomes possible to actuate the switch lever at an arbitrarily small power level.

By allowing complete switch lever actuation, from its extreme ON-position to its extreme OFF-position, to take as long as one second from start to finish, the motor power output requirement gets to be acceptably modest; and actuation can then readily be accomplished by way of a substantially conventional miniature DC motor of dimensions no larger than 10 mm×20 mm×20 mm. Correspondingly, the electrical power required by the motor now becomes adequately modest to permit the use of two ordinary AAA-cells for the built-in battery.

In this connection, it is noted that a two-way solenoid was considered but found to be inapplicable as the prime mechanical mover in subject actuator/timer unit for the basic reason of requiring excessive power. This excessive power requirement is due to the fact that a solenoid has to develop all the required force and distance (energy) in but a single brief stroke—with no feasible way of trading time for power, as can so easily be done with a motor and a gear mechanism.

That is, with a solenoid, all the required force and movement (energy) has to be produced in a single-stroke electro-magnetic action; which implies a required peak power level far higher than that resulting when using motoring action (which implies multi-stroke electro-magnetic action) and a speed-reducing gear mechanism.

During the process of actuation, actuator frame AF is apt to slide up and down on the rim of the support frame SF. Also, as the switch lever is being pushed up or down by the actuator frame, there is a degree of sliding between the switch lever and the inner edges of the actuator frame. To minimize power waste, low-friction surfaces have been provided.

Details of Operation

With reference to FIG. 5, when the DC motor is provided with a DC voltage across its electrical input terminals, the motor's output shaft will rotate in a direction corresponding to the polarity of this DC voltage. The rotating motor shaft will, by way of the indicated gear and pulley arrangement, cause the actuator frame to move up or down, thereby causing the switch lever SL to move correspondingly. With the MIT1 terminal being positive with respect to the MIT2 terminal, the motor shaft rotates in such a direction as to cause the actuator frame to move the switch lever in the down- or OFF-direction, thereby eventually to cause the wall switch to enter its OFF-position. Correspondingly, with the MIT1 terminal being negative with respect to the MIT2 terminal, the motor shaft rotates in such a direction as to cause the actuator frame to move the switch lever in the up- or ON-direction, thereby eventually to cause the wall switch to enter its ON-position.

In an ordinary wall switch, as the switch lever is slowly pushed from its ON position to its OFF position and after it has reached slightly past the middle position between ON and OFF, a mechanism within the wall switch causes a bi-stable or toggle action to occur. As this occurs, the switch lever—without having to be pushed further—makes a precipitous movement in the direction in which it was being pushed.

To operate properly with some types of wall switches, the opening in the actuator frame should be large enough not to hinder this precipitous onward movement of the switch lever.

With most wall switches, however, complete ON/OFF control can be achieved without having to move the switch lever all the distance between its extreme ON-position and its extreme OFF-position, which amounts to about 15 mm or about 60 degrees in angle. Rather, complete ON/OFF control can be achieved by making the switch lever move between two positions that corresponds to only about one tenth of that. Thus, complete ON/OFF control can be effected by moving the switch lever back and forth a distance of only about one sixteenth of one inch. However, the particular position about which this small movement must take place varies with different types of wall switches.

The overall function of the actuator/timer unit involves the programmed actuation by the IC of the DC motor in the one or the other direction, thereby moving the switch lever either up or down to correspondingly turn the switch ON or OFF. The quartz element in combination with the IC acts as an accurate clock, and therefore as an accurate time-base for providing programmable diurnally repetitive ON/OFF actuations of the wall switch.

With reference to FIG. 3, once mounted in its place on a standard wall switch, the operation and programming of subject actuator/timer unit is quite similar to that of the timer-switcher of FIG. 1 in U.S. Pat. No. RE 31,848 to Nilssen; which is to say that the time-of-day as well as the various desired ON/OFF-actuation-times can be programmed into the actuator/timer unit by way of pressing various keys in various combinations and/or sequences. Thereafter, the actuator/timer unit will proceed to execute the various desired ON/OFF-actuations at the programmed points in time, while the numeric display means NDM indicates current time-of-day.

However, while the overall operation and programming of the already mounted actuator/timer unit is quite similar to that of said timer-switcher, the installation and overall functional capabilities have several significant differences.

A first significant difference between subject actuator/timer unit and said timer-switcher relates to the over-ride key ORK. By pressing this over-ride key, the IC acts to actuate the motor in such direction as to reverse the state of the wall switch—from ON to OFF or vice versa—regardless of the state in which it exists, and without affecting the previously entered program.

A second significant difference relates to the fact that subject actuator/timer unit is battery operated and comprises its own built-in clock means, thereby making it totally independent of the presence of 60 Hz AC voltage inside the wall switch.

A third significant difference relates to ease of mounting. The actuator/timer unit can simply be mounted by placing it over the switch lever of any standard wall switch and by pressing it onto the face plate by way of the adhesive mounting tape (with or without use of the screw-on frame of FIG. 3), thereby requiring no skill beyond that possessed by most any ordinary person. The mounting of said timer-switcher, on the other hand, involves the removal of the face plate and the existing toggle switch, direct connections with the power-line-connected wires inside the wall switch, etc.

A fourth significant difference relates to load handling capacity. The actuator/timer unit can handle any load that can be handled by the already-installed standard wall switch, which is typically rated at 15 Ampere. Said timer-switcher, on the other hand, uses a Triac for effecting load switching; which implies severe limitations on the amount of current that can safely be handled.

A fifth significant difference involves safety and listability by Underwriters Laboratories Inc. of Northbrook, Ill. 60062. Due to the predominant failure mode of Triacs, said timer-switcher (which uses a Triac for power switching) can not readily be U.L listed for operation on inductive loads, such as motors and fluorescent lamp ballasts. No such limitations would apply to subject actuator/timer unit.

A sixth significant difference relates to ease of programming. The actuator/timer unit may be programmed while removed from the wall switch; which is not possible with said timer-switcher. Also, the actuator/timer unit may readily be moved from one wall switch to another without loss of programming; which, very importantly, includes the basic time-setting relating to time-of-day.

A seventh significant difference relates to permanency of programming. A power failure exceeding a few seconds in duration could cause said timer-switcher to lose its memory; whereafter it would have to be re-programmed, both in respect to time-of-day as well as in regard to the desired ON/OFF periods. Since subject actuator/timer unit operates on a built-in battery-operated clock and memory, a power failure will have no effect on its programming—regardless of its duration.

An eighth significant difference relates to flexibility of use. In sharp constrast with said timer-switcher, subject actuator/timer unit may readily be moved from one wall switch to another.

Again with reference to FIG. 5, it is made note of the fact that each time the IC actuates the motor, it does so in a special manner.

Initially, before doing any adjustments to or programming of the actuator/timer unit, when actuated by the over-ride switch ORK, the IC provides a DC voltage of a first polarity to the DC motor. This DC voltage is provided for as long as it takes for switch means SM to open and close 24 times, which represents a movement of the actuator frame AF that is adequate to make the switch lever move from its one extreme position to its other extreme position, but not for longer than a preset time period.

If actuated once more by the over-ride key, the IC provides a DC voltage of a second (i.e., opposite) polarity to the DC motor; and again provides this voltage for a long as takes for the switch means to open and close 24 times, but not for longer than said preset time period.

It is to be noted that the actuator frame may be stopped by the switch lever at the end of its allowed travel—thereby, in turn, possibly causing the motor to stall—while the IC is still providing voltage to the motor. However, the magnitude of the current absorbed by the stalled motor is not substantially larger than that of than the motor's normal running current.

Alternatively, depending upon the degree of force required to overcome the detent means by which the actuator frame AF is connected with the notched endless belts (which degree of force can be adjusted by design and/or during manufacturing), the motor may continue to run even after the actuator frame has come to a stop.

After having been primed by a couple of actuations of the over-ride key, the actuator/timer unit is ready for initial programming; which ideally, but not necessarily, should include an adjustment of the number N of openings/closings of switch means SM that will occur in response to each actuation—whether this actuation is accomplished by the over-ride key or by the IC. By providing for just the minimally required number of such openings/closings, the time required for actuation is minimized, as is also the average power drain from the battery.

This initial programming also should include a selection of the point, represented by a number M, about which these N openings/closings will occur—the number M being chosen between 1 and 24, with 24 representing the maximally possible total number of openings/closings between the switch lever's most extreme positions.

Thus, for instance, if for a given wall switch it be found or known that the switch lever acts to cause this particular type of wall switch to change from its ON-state to its OFF-state (and/or vice versa), at the 11th position from the extreme ON-position of the switch lever, the number M is chosen (by way of one of the programming keys and the display means) to be 11. Similarly, if it if be found or known that 4 is an adequate number for N for this particular type of wall switch, then this number is programmed into the actuator/timer unit by way of one of the programming keys.

After this initial programming, the IC will stop powering the motor immediately each time after having caused switch means SM to go through N openings/closings.

Without the initial programming, factory preset programming will provide for N to be 24, in which case the number M is of no importance.

Before or after initial programming, the actuator/timer unit may be programmed in terms of time-of-day and the desired ON/OFF actuation times.

Comments

It is not necessary to use a center-tapped battery for the proper operation of the actuator/timer unit. A single battery could be used in conjunction with providing for double-pole double-throw switching, either by the IC or by mechanical means actuated in accordance with the position of the actuator frame. Or, as yet another alternative, it would be possible to use a single battery in combination with a three-terminal motor.

One important requirement of the actuator/timer unit is that it operate quietly. Such is indeed the case with the particular preferred embodiment presented. However, an adequate degree of quietness would not be easy to achieve by way of a solenoid, especially not if this solenoid were to be used to operate a ratchet mechanism.

The use of the screw-on frame of FIG. 4 is entirely optional. It may be useful in those situations where the front surface of the wall switch face plate might not be suitable for direct use with the adhesive mounting tape. It would be particularly useful, however, in those situations where it is anticipated that the actuator/timer unit is to be removed and replaced frequently. In that case, a couple of small pieces of so-called Velcro could be attached at selected points on the front surface of the screw-on frame; and pieces of opposite "polarity" Velcro could be correspondingly attached to the back of the actuator/timer unit.

It is noted that, especially in foreign counties, other than the herein described ordinary wall switches are commonly used; and even within the United States, different types of wall switches are occasionally used. However, it would be obvious to apply the teachings herein provided to make actuator/timer units to work effectively with such other types of wall switches.

It is important to note that the length of the slot of opening in the actuator frame AF through which the switch lever protrudes may be chosen either to be more-or-less just long enough to accept the largest anticipated switch lever, or it may be chosen to be so long as to permit the toggle action of the switch lever to take place without impediment. The width of the slot is of relatively minor concern as long as it is sufficiently wide to permit easy insertion of the switch lever.

For most applications, it is anticipated that the slot be just long enough to accomodate the switch lever.

Definitions

The terms "standard wall switch" and "ordinary wall switch" both refer to the type of wall switch depicted by FIG. 1; which type of wall switch has a switch lever adapted to be stably positioned in either of two distinct positions: an ON-position and an OFF-position. The switch lever may be moved, and/or it may be held still at any point, between these two positions. When gradually pushing the switch lever from one of these positions toward the other, a point is normally reached where the switch lever will, if not restrained, continue to move by itself in the direction in which it was being pushed.

The term "programmable", particularly as used in connection with an actuator/timer unit, refers to a characteristic that allows this actuator/timer unit to be so affected or adjusted (i.e., programmed) as to cause it to operate (i.e., to actuate and de-actuate) repeatedly and continuously in accordance with a desired time pattern, until such time as it is re-adjusted or re-programmed. Thus, the term "programmable" would not be applicable to an actuator/timer unit that only provides for a strictly limited number of actuations, or that does not permit re-programming of the actuation pattern.

It is believed that the present invention and its several attendant advantages and features will be understood from the preceeding description. However, without departing from the spirit of the invention, changes may be made in its form and in the construction and interrelationships of its component parts, the form herein presented merely representing the presently preferred embodiment.

I claim:

1. An assembly characterized by including:

a wall switch having a pair of terminals connected with a pair of power line conductors as well as with a load; the terminals being so arranged that: (i) when they are electrically connected together, a power line voltage is applied to the load; and (ii) when they are electrically disconnected from each other, the power line voltage is removed from the load; and a sub-assembly connected in interactive relationship with the wall switch and operative to cause the terminals to be shorted together at certain pre-determined points in time and to be disconnected from each other at certain other predetermined points in time; the sub-assembly being further characterized in that: (i) the pre-determined points in time repeat in a substantially periodic manner; (ii) a wall switch face plate is interposed between the sub-assembly and the terminals, the face plate being characterized by having a central aperture; (iii) it will function to cause the pre-programmed points in time to occur irrespective of the presence of a power line voltage at the power line conductors; and (iv) it does not include a manually rotatable control dial operative to adjust said pre-determined points in time.

2. An arrangement comprising:

a wall switch having a face plate and a switch lever protruding through an aperture in the face plate; the face plate being of ordinary size and shape; and a programmable actuator mounted onto the wall switch in engagement with the switch lever; the programmable actuator being further characterized by causing repetitive and periodic reciprocating movement of the switch lever in accordance with a pre-established program; the actuator being characterized by not including a solenoid nor requiring connection with a power line voltage; the programmable actuator being further characterized by not including a manually rotatable control dial operative to modify said pre-established program.

3. An arrangement comprising:

a wall switch including: (i) a face plate having a central aperture and a frontal periphery; and (ii) a switch lever protruding through the central aperture; and an actuating assembly mounted onto the wall switch face plate in mechanical engagement with the switch lever; the actuating assembly being further characterized by periodically causing the switch lever to move up and down in accordance with a pre-established adjustable pattern, thereby correspondingly to actuate and de-actuate the wall switch; the actuating assembly also being characterized by not including a manually rotatable control dial.

4. The arrangement of claim 3 wherein the actuating assembly is characterized by including a rechargeable battery.

5. The arrangement of claim 3 wherein the actuating assembly is characterized by including a light.

* * * * *